US005215208A

United States Patent [19]

Jackson

[11] Patent Number: 5,215,208

[45] Date of Patent: Jun. 1, 1993

[54] MODULAR WINE CELLAR UNIT

[76] Inventor: Anthony Jackson, 285 Cecil Street, South Melbourne, Victoria 3205, Australia

[21] Appl. No.: 537,803

[22] Filed: Jun. 8, 1990

[51] Int. Cl.[5] ..... B65D 1/24

[52] U.S. Cl. ..... 220/516; 220/521; 220/509; 206/427; 206/545; 62/457.1; 62/457.5

[58] Field of Search ..... 206/139, 203, 427, 545; 62/457.1, 457.5; 220/352, 366, 512, 513, 515, 516, 521, 526, 555, 903, 509

[56] References Cited

U.S. PATENT DOCUMENTS

| | | | |
|---|---|---|---|
| 2,944,695 | 7/1960 | Yusz | 220/526 |
| 3,491,913 | 1/1970 | Giraudet et al. | 220/352 |
| 3,578,027 | 5/1971 | Zopfi | 220/352 |
| 3,670,918 | 6/1972 | Mitchell | 220/516 |
| 3,677,435 | 7/1972 | Davis | 220/366 |
| 3,734,336 | 5/1973 | Rankow et al. | 220/516 |
| 3,809,280 | 5/1974 | Park et al. | 220/366 |
| 4,119,248 | 10/1978 | Butler et al. | 206/203 |
| 4,295,345 | 10/1981 | Atkinson | 62/457.5 |
| 4,344,300 | 8/1982 | Taylor | 62/457.5 |
| 4,932,527 | 6/1990 | Hayes | 206/428 |

FOREIGN PATENT DOCUMENTS

| | | |
|---|---|---|
| 90682 | 12/1983 | Australia . |
| 104041 | 9/1988 | Australia . |
| 104042 | 9/1988 | Australia . |
| 104930 | 9/1988 | Australia . |
| 104931 | 9/1988 | Australia . |

*Primary Examiner*—David T. Fidei

*Attorney, Agent, or Firm*—Birch, Stewart, Kolasch & Birch

[57] ABSTRACT

A modular unit, suitable for above-ground cellaring of bottled wine, including a body member of insulating material which defines a cellaring chamber region therein for bottled wine, the body member having a front access opening, and a separable cover member of insulating material able to be fitted to the body member for closing the opening and to be removed for access. The cover member is adapted to be retained by means of a friction fit in the opening and has inner and outer surfaces, and a peripheral edge between those surfaces. The cover member is fitted to the body member by being at least partially received in the opening to achieve a friction fit around the peripheral edge between that edge and an opposed sealing surface defined around the opening; with the peripheral edge and the sealing surface being configured such that the friction fit is achieved only in a final stage of application of the cover member.

5 Claims, 2 Drawing Sheets

FIG. 3A
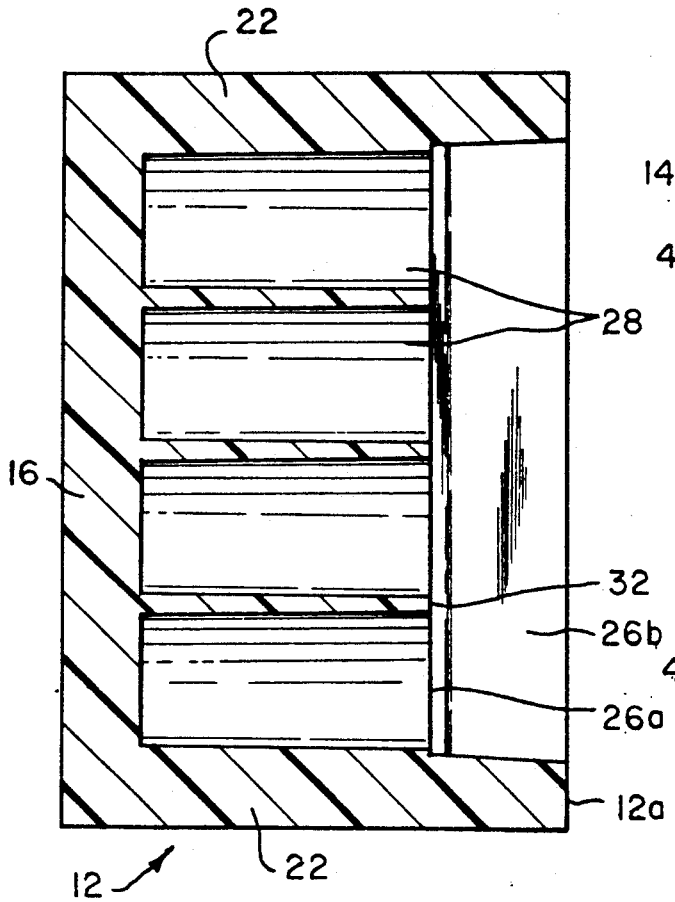
FIG. 3B
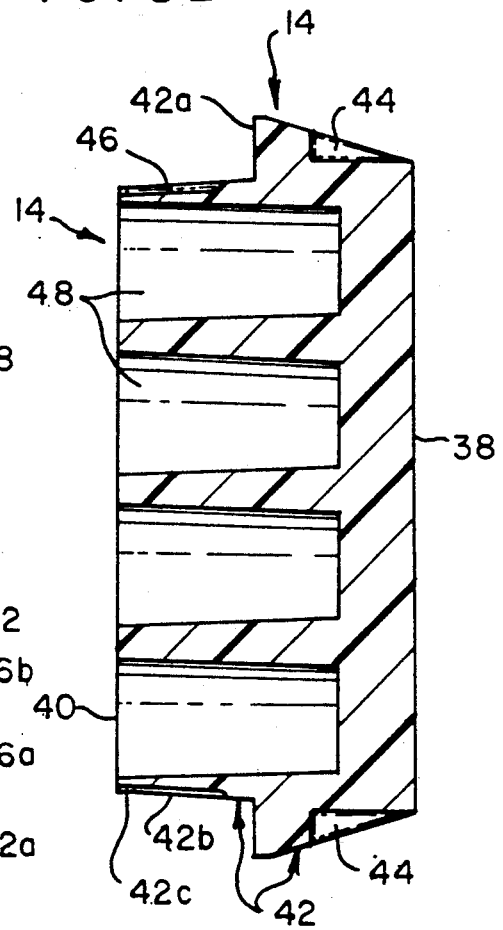
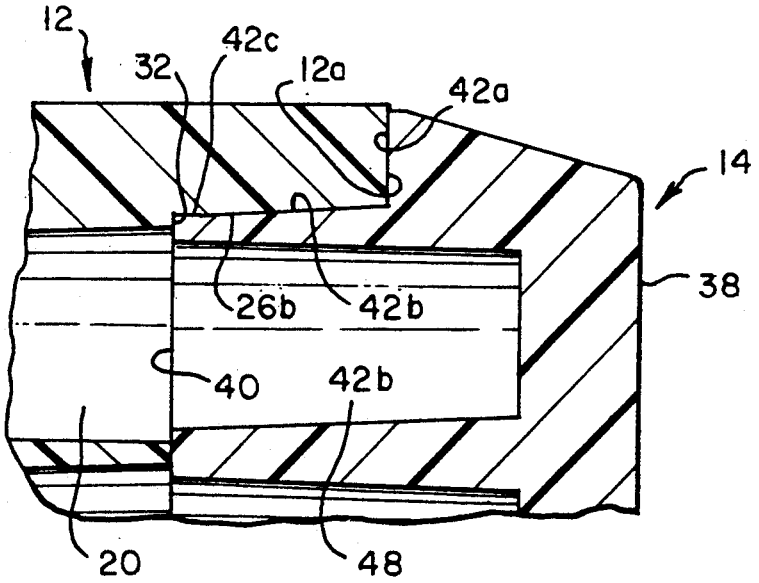
FIG. 4

MODULAR WINE CELLAR UNIT

BACKGROUND OF THE INVENTION

1. Field of the Invention

This invention relates to a modular cellar unit suitable for above-ground cellaring of bottled wine.

2. Description of Related Art

Bottled wine requires cellaring at a substantially constant temperature, or at least within a relatively narrow temperature range. This requirement presents a difficulty for many wine consumers. While a below-ground cellar is ideal, the cost of building such a cellar is substantial. Also, not all residences can be provided with a below-ground cellar. Many consumers therefore find it necessary either to purchase wine a relatively short time before consumption, or to rely on inadequate storage in cupboards or racks in which the wine is likely to be exposed to undesirably wide ambient temperature fluctuations.

SUMMARY OF THE INVENTION

The present invention is directed to providing a modular unit which is suitable for above-ground cellaring of bottled wine. In most highly preferred forms of the invention, the modular unit is suitable for use in a stacked arrangement comprising a plurality of similar modular units to which further modular units can be added as required.

According to the present invention, there is provided a modular cellar unit having a body member which defines a cellaring chamber region therein for bottled wine, the body member having an opening at the front thereof enabling access to the chamber region, the modular unit further including a separable cover member able to be fitted to the body member for closing the opening and to be removed therefrom to enable such access, the cover member being adapted to be so fitted so as to be retained by means of a friction fit in the opening.

The modular unit may be of rectangular or cubic form, with the body member having top, bottom and rear walls, and side walls which, together with the top and bottom walls, define the front opening. Such form for the modular unit is preferred, particularly as it enables bottles of wine to be cellared in a substantially horizontal disposition in a vertical and horizontal array. While other forms are possible, they are less preferred, not only because they are less desirable for cellaring but also because they enable less than optimum stacking of similar cellaring units.

The cover member has a peripheral profile substantially corresponding to that of the opening of the body member. The cover member has inner and outer surfaces, which may be substantially planar, and a peripheral edge extending between those surfaces. The cover member is adapted to be fitted to the body member by being at least partially received in the opening to achieve a friction fit around the peripheral edge, between that edge and an opposed sealing surface which is defined by the top, bottom and side walls and is adjacent to and extends around the opening. The cover member, when fitted to the body member, most preferably substantially seals the chamber region on achieving the required friction fit.

The friction fit is achieved between the peripheral edge of the cover member and the sealing surface of the body member. That edge and the sealing surface are normal to the inner and outer surfaces of the cover member and the direction of application of the cover member when being fitted in the opening. However, if the friction fit is achieved across at least a major part of the width of the peripheral edge, there is difficulty both in expelling air from the chamber region when fitting the cover member and, having expelled air to achieve a friction fit, in then removing the cover member. Accordingly, the peripheral edge of the cover member and the opposed surfaces of the body member are configured so that the required friction fit is achieved only in a final stage of application of the cover member, around only a portion of the width of the peripheral edge.

Over a first part of its width, the peripheral edge of the cover member is tapered outwardly away from its inner surface towards its outer surface, with there being at least one second part over that width at which the peripheral edge is substantially normal to those surfaces. The sealing surface of the body member is correspondingly shaped, with the arrangement being such that, as the cover member is fitted to the body member, the egress of air from the chamber region is permitted until the at least one second part of the peripheral edge of the cover member comes into frictional engagement with the corresponding part of the sealing surface of the body member.

In a first form, the cover member has one such second part, which is a marginal strip of the cover member between the first, tapered part and the inner surface. In that one form, the sealing surface of the body member tapers inwardly from a front edge of the body member over a distance substantially equal to the width of the taper of the cover member, with the sealing surface thereafter being normal to the rear wall over a distance at least equal to the width of the marginal strip. In a second form, the cover member has one second part which extends from the edge of the first part which is remote from the inner surface. In that second form, the sealing surface of the body member, at a margin strip extending inwardly from the front edge of the body member, is normal to the rear wall over a distance substantially equal to the width of the second part of the cover member, and thereafter tapers inwardly. In a third form, the cover member has two second parts which, respectively, correspond to that of the first and second forms, with the sealing surface of the body member being correspondingly shaped.

The cover member may be fully receivable within the opening of the body member such as to provide a flush fit with the front edge of the body member. In that case, the outer surface of the cover member may be provided with a handle, such as a strap, which a user can grip for removal of the cover member from the body member. Alternatively, as is preferred, the peripheral edge of the cover member is stepped to define an outwardly extending flange portion which, on fitting the cover member to the body member, extends over and abuts the front edge of the body member. Such flange portion can be provided with forwardly facing finger-grip recesses by which a user can grip the cover member for its removal from the body member. However, in each case, an abutment preferably is defined at the inner edge of the sealing surface so as to limit the extent to which the cover member can be inserted into the opening on being fitted to the body member.

The angle of taper of the tapered part of the peripheral edge of the cover member is relatively small. Thus, the tapered part may be at an angle of as little as from 5° to 10° away from normal to the inner and outer surfaces of the cover member. In general, such angle does not exceed about 15°. The corresponding tapered part of the sealing surface of the container body preferably is at substantially the same angle from normal to the rear wall of the body member as is chosen for the peripheral edge of the cover member.

The modular cellar unit preferably is such that a plurality of bottles of a wine can be stored therein on their side. In one preferred form, the cellar unit has a chamber region of a size enabling storage of 12 such bottles such as in a 6 by 2 or, most preferably, in a 3 by 4 array. Preferably the chamber region is divided by partition means, to provide a separate compartment for each bottle of wine to be cellared therein. Each such compartment thus is able to isolate each bottle from the others. The partition means most conveniently is such that each compartment is round in cross-section when viewed from the opening.

The partition means may extend from the rear wall a distance less than the corresponding dimension of the top, bottom and side walls. Preferably, the compartments have a depth such that a standard wine bottle is not fully receivable within each compartment. In such arrangement, the inner surface of the cover member may be provided with a plurality of recesses, each in line with a respective compartment when the cover member is fully applied to the body member. The recesses preferably enable a portion of a bottle projecting from a compartment to be received within a respective recess when the cover member is so applied.

The modular cellar unit of the invention can be made from a variety of materials suitable for its use in cellaring bottled wine. That is, the material is to be of an insulating material able to maintain wine at a substantially constant temperature, despite variation in ambient temperature. The unit also is to have external walls of the body member and a cover member of a sufficient thickness to achieve a substantial degree of thermal insulation for wine cellared therein. The container may, for example, be made from a suitable foamed plastics material. Alternatively, the external walls of the body member and the cover member may include a thickness of such foamed material in, for example, a laminated structure. Foamed polystyrene is a particularly suitable material, especially as it has sufficient structural rigidity to enable it to be the sole material of which the unit is made. Where the unit is made of a foamed plastics material, such as foamed polystyrene, the unit preferably is formed by molding the body member and cover member from that material during a foaming stage, using suitable molds. For a cellar unit according to the invention having partition means as described above, the partition means can be formed integrally with the body member when the latter is molded from foamed plastics material.

BRIEF DESCRIPTION OF THE DRAWINGS

In order that the invention may more readily be understood, description now is directed to the accompanying drawings, in which:

FIGS. 3A and 3B are transverse sectional views on lines IIIA and IIIB, respectively, of FIGS. 2A and 2B; and FIG. 4 is an enlarged, fragmentary sectional view of the unit of FIG. 1.

DETAILED DESCRIPTION OF PREFERRED EMBODIMENTS

Figure 1:
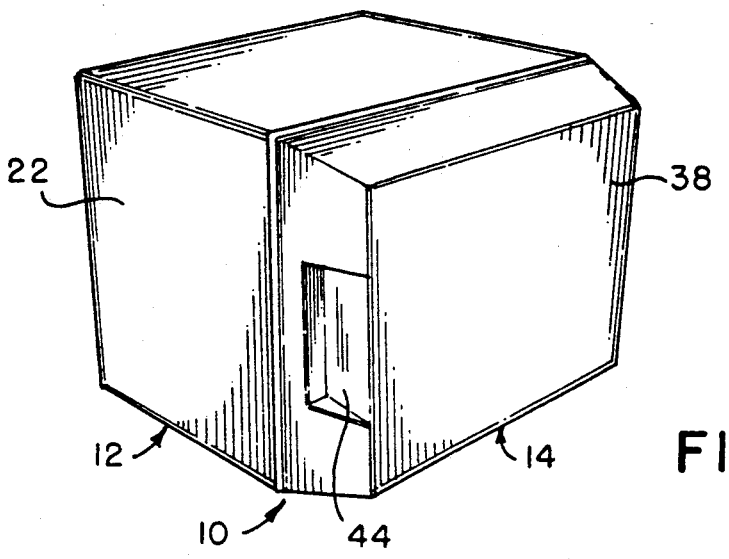
FIG. 1 is a perspective view of a modular cellar unit according to the invention.
Figure 2A:
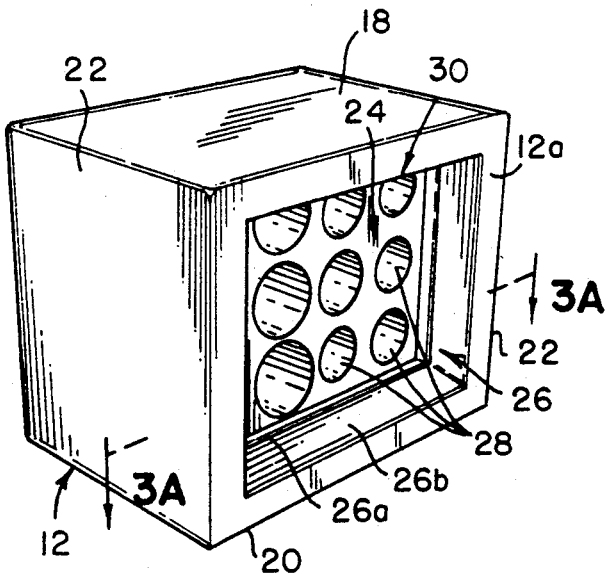
FIGS. 2A and 2B are perspective views respectively showing the body and cover members of the unit of FIG. 1.
Figure 2B:
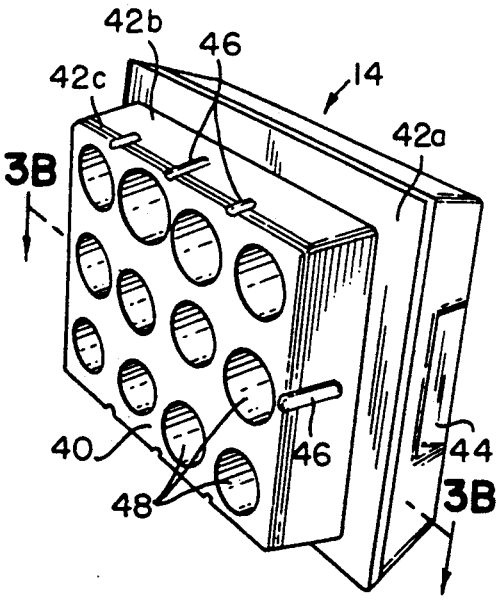

A cellar for bottled wine, for optimum cellaring of wine, is required to be:

dark;

free of vibration;

stable in temperature, reducing both daily and seasonal temperature variations to a minimum;

able to maintain a reasonable level of humidity;

able to allow bottles to be cellared horizontally; and capable of being organized and cataloged in a manner enabling a given wine to be easily located and accessed.

The modular cellar unit of the present invention is compatible with each of these requirements, as detailed herein. Also, while the unit of the invention is suitable for above-ground use in providing such compatibility, it also is able to be used to advantage in a below-ground situation.

In the drawing, the modular cellar unit 10 has a body member 12 and a cover member 14, each separately formed by molding a foamable plastics material such as polystyrene. The body member 12 has a rear wall 16, top wall 18, bottom wall 20 and side walls 22. A chamber region 24 is defined by walls 16, 18, 20, 22, with region 24 having a front opening 26 which is opposite rear wall 16 and is defined by the forward edges of walls 18, 20, 22.

Chamber region 24, over a major part of the distance forwardly from rear wall 16, is divided into compartments 28. As shown, compartments 28 are defined by partitioning means 30 within chamber region 24 and formed integrally with walls 16, 18, 20, 22. Each compartment 28 is of circular cross-section, while each decreases slightly in cross-section towards wall 16. The taper of each compartment 28, in addition to facilitating molding of body 12, is such that a bottle of wine is able to be received end-wise therein, to locate its base adjacent to rear wall 16, so that during cellaring in unit 10, the bottle is inclined slightly downwardly to its top so as to retain wine against its closure or cork of the bottle.

The forward end of partitioning means 30 serves as an abutment surface 32 at the inner extent of opening 26. Around walls 18, 20, 22, opening 26 is defined by a first part **26*a* of the inner surface of those walls which is substantially normal to rear wall 16. From part 26*a*, opening 26 increases substantially uniformly in cross-section over part 26*b*, due to the inner surface of walls 18, 20, 22** tapering or flaring outwardly, such as at an angle of from 5° to 10° to such normal.

Cover member 14 is adapted to fit in, and to provide a friction seal around, opening 26 of body member 12. Cover member 14 has an outer surface 38 and an inner surface 40, with surfaces 38, 40 being substantially parallel.

Cover member 14 has a peripheral edge 42 extending between surfaces 38, 40. Edge 42 is stepped intermediate surfaces 38, 40 to define shoulder **42*a* of a peripheral flange 43 which, on application of cover member 14 to body member 12, overlies and abuts against peripheral edge 12*a* of body 12, defined by walls 18, 20, 22. Between shoulder 42*a* and inner surface 40, edge 42 is configured so as to be of complementary form to opening 26 of body member 12. Thus, from shoulder 42***a*, edge 42 tapers substantially uniformly inwardly over part 42*b* thereof, with the angle of taper being substantially the same as that of part 26*b* of opening 26. Between part 42*b* and inner surface 40, edge 42 has a part 42*c* which is substantially normal to surfaces 38, 40, with a section of part 42*c* taken parallel to surfaces 38, 40 being such that part 42*c* is able to provide a friction fit in and with part 26*a* of opening 26.

Between shoulder 42*a* and outer surface 38, cover member 14 has an opposed pair of recesses 44 formed in its peripheral edge 42. Recesses 44 enable cover member 14 to be held manually for application of cover member 14 to body member 12, and for its removal therefrom.

For application of cover member 14 to body member 12, it is presented to opening 26 to locate its inner surface 40 across opening 26. Cover member 14 then is moved towards opening 26 so as to locate parts 42*b*, 42*c* of its edge 42 against parts 26*b*, 26*a*, respectively, of opening 26 and to bring shoulder 42*a* against edge 12*a* of body 12 and surface 40 against abutment surface 32.

As cover member 14 enters opening 26, it is able to displace air from within body member 12 until its part 42*c* commences to enter within part 26*a*. The egress of air is facilitated by the reverse taper of respective parts 26*b*, 42*b* of opening 26 and edge 42. However, to assist in achieving such egress, edge 42 is provided with a plurality of grooves 46, which extend from the junction of surface 40 and edge 42, towards shoulder 42*a*. Grooves 46 preferably have a depth which is covered by abutment surface 32. Thus, on full application of cover member 14 to container body 12, surface 32 extends across the open, adjacent ends of grooves 46 to provide a seal thereat.

As an alternative to grooves 46, similar grooves (not shown) can be formed in the inner surface of one or more of walls 18, 20, 22. In such case, the grooves extend from abutment surface 32 towards edge 12*a*, with the grooves preferably terminating inwardly of edge 12*a*.

As will be appreciated from the above description, the width of opening 26, between abutment surface 32 and edge 12*a* is substantially equal to that part of the width of edge 42 between shoulder 42*a* and surface 40. Also, the width of parts 26*a* and 26*b* of opening 26 is substantially equal to that of parts 42*c* and 42*b*, respectively, of edge 42.

The axial extent of compartments 28 may be less than the height of a standard wine bottle, such that, with a bottle received in a compartment 28, its neck may project within opening 26 and possibly even beyond edge 12*a* of body member 12. This is desirable for access to and removal of bottles from body member 12. However, to accomodate such projection of the bottles, surface 40 of cover member 14 is provided with recesses 48. Each recess 48 is positioned so that, with cover member 14 applied to body member 12, it is aligned with a respective compartment 28. Recesses 48 thus are received over projecting bottle necks when cover member 14 is applied to body member 12, with the depth of recesses 48 being such that the full bottle height can be accommodated.

Modular cellar unit 10 is formed of foamed plastics material such as polystyrene, and enables excellent above-ground cellaring of bottled wine. Unit 10 provides a high degree of insulation, so that the wine is able to be retained within a relatively narrow temperature range, despite a substantially greater variation in ambient temperature. The friction fit between part 42*c* of cover member 14 and part 26*a* of opening 26 of body member 12 retains cover member 14 in good sealing engagement with body member 12. Also, while cover member 14 readily is able to be applied and removed, even where unit 10 is one of a stack of like units, such sealing is retained while required without likelihood of cover member 14 falling from body member 12. Retention of cover member 14 is achieved by the dimensions of its edge 42 relative to opening 26, but it also is enchanced by the relatively high coefficient of friction of foamed plastics material.

As shown, edge 42 of cover member 14 preferably has a pronounced taper from shoulder 42*a* to front face 38. This facilitates access when applying or removing cover member 14 of a cellar unit 10 located within a stack of like units.

As indicated above, the insulation material used to form body and cover members 12,14 of unit 10 preferably is a foam plastics material. Expanded polystyrene, produced from foamable beads, is most highly preferred, with the polystyrene preferably being of a high density grade.

Unit 10 preferably has a minimum external wall thickness of about 4.5 cm, preferably of about 5.0 cm. Thus, each of walls 16,18,20 and 22 preferably are of such minimum thickness. Such thickness is necessary not only to achieve the required degree of thermal insulation and resultant temperature stability, but also to achieve a sufficient strength and rigidity for unit 10. The upper limit for the external wall thickness principally is dictated by economic considerations, but generally need not exceed about 10 cm, with an upper limit of about 8 cm typically being sufficient. Similar considerations apply to cover member 14; the thickness being considered being that at the base of recesses 48.

Partitioning means 30 enhances the strength of unit 10, as is necessary for stacking a number of similar units. Means 30 preferably has a minimum thickness between adjacent compartments 28 of about 10 mm. Above that level, strength is further enhanced, although it generally is not practical to have a thickness for means 30, between compartments 28, in excess of about 2.5 cm. Generally it is preferred that that thickness of means 30 is from about 10 to 20 mm.

The insulation used to form body and cover members 12,14 of unit 10, particularly where of foamed plastics material, preferably has a density of from about 25 to 35 g/liter. Most preferably, the density is from about 25 to 30 g/liter. Cost effectiveness, as in this case of wall thickness, is an important determinant of insulation density, although it generally is preferable to increase wall thickness than density in seeking to maximize thermal insulating capacity.

Typically the width of part 42*b* is a minor portion of the total thickness of cover member 14, between shoulder 42*a* and inner surface 40. Similarly, the width of part 26*a* of opening 26 is a corresponding minor portion of the total depth of opening 26 between abutment surface 32 and peripheral edge 12*a* of body member 12. In each case, the minor portion of the respective total width or total depth is less than 30%, most preferably less than 20%. Parts 42*b* and part 42*a* each may be from about 10 to 20 mm in width, most preferably from 14 to 20 mm in width.

While parts 42b and 26a are respectively shown adjacent to surface 40 and surface 32, this is not essential. Thus, part 42b can be adjacent to shoulder 42a or at a location intermediate surface 40 and shoulder 42a, while part 26a can be adjacent edge 12a or intermediate surface 32 and edge 12a. However, in each case, it of course is necessary that parts 42b and 26a are each positioned such that they come into substantially complete frictional engagement when cover member 14 is fully applied to opening 26.

Notwithstanding that surface 32 of means 30 is specified as an abutment surface, it is not necessary that surface 32 is in fact abutted by surface 40 when cover member 14 is fully applied. To assist in removal of cover member 14, it can be of benefit if there is a slight clearance, such as of about 1 mm between surfaces 32,40 with member 14 fully applied. Such clearance assists in the ingress of air in through opening 26 when member 14 is being removed. Also, it can similarly assist in removal of member 14 if at least one of grooves 46 is continued across surface 40, such as to an adjacent compartment 28.

The modular cellar unit 10 has a practical advantage in that it is able to be stacked in a suitable horizontal and/or vertical array of similar units, such as against or adjacent a wall of a room or cupboard. Thus, a horizontal row of similar units can be disposed side by side, or such units can be stacked in a column. The array can comprise successive rows stacked one on another, or successive side by side columns. Additional units can be added to the array as required. Obviously, such array typically will have the cover member of each unit accessible from the one side of the array for ease of access to each unit.

The unit 10, at least in the preferred form of the invention, has sufficient strength and rigidity to enable vertical stacking of several similar units each holding its full capacity of bottled wine. Obviously there is a limit to the number of similar units able to be stacked one on the other if the wall thickness of each unit is not to be increased to a limit resulting in insufficient overall space utilization. However, in the preferred form of the invention, a stack can be up to about ten similar units in height, but when in excess of about eight units, the units preferably are in horizontal rows, with successively higher rows staggered rather than in adjacent columns.

The external wall thickness of unit 10 is such that, with its cover member 14 applied, wine cellared therein is in a substantially light-free environment. The unit thus complies with the general cellaring requirement that wine be cellared in the dark.

Construction of unit 10 from insulating material, in particular of foamed plastics material such as expanded polystyrene, results in the unit substantially isolating wine therein from external vibration. The unit therefore complies with the further cellaring requirement for this.

The use of insulating material, in particular expanded polystyrene, also satisfies the further important requirement for temperature stability, as well as the requirement for sufficient humidity. The specified external wall thicknesses and overall densities achieve excellent temperature stability, comparable to that obtained in a below-ground cellar, notwithstanding external variation in diurnal and seasonal temperature. The unit is capable of maintaining wine cellared therein at a temperature of from about 14° C. to 22° C. mid-summer and mid-winter, with a daily variation of not more than about 1° C.except in climates subject to extreme diurnal variations. Also, temperature stability is enhanced where the units are in a closely packed array of similar units.

The insulating material, such as expanded polystyrene exhibits a degree of porosity which is such as to retain the bottled wine in an atmosphere having a sufficient degree of humidity. In general, the interior of the unit assumes the ambient humidity of the surrounding atmosphere.

Bottled wine cellared in unit 10 has the bottles disposed horizontally. This ensures that corks remain moist, while the unit also provides protection from cork moths not achieved in a conventional below-ground cellar. Compartments 28 preferably taper slightly outwardly from rear wall 16 towards opening 26, such that the bottles slope slightly downwardly toward their neck ends, allowing any ullage to develop appropriately at the upper rear end. Bottles cellared in this fashion also are readily able to be grasped by the neck, for ease of removal from a unit 10.

As will be appreciated, units 10 facilitate grouping of wine and labelling of the modules to indicate their contents, as appropriate for required organization and cataloging of wines.

Finally, it is to be understood that various alterations, modifications and/or additions may be introduced into the constructions and arrangements of parts previously described without departing from the spirit or ambit of the invention.

I claim:

1. A modular cellar unit, suitable for above-ground cellaring of bottled wine, said unit comprising a body member and a cover member, each separately formed and of unitary construction; said body member comprising an outer body portion and, formed integrally with the outer body portion, an inner body portion; wherein:

(a) said outer body portion of the body member has a box-like external form defined by
- a horizontally disposed bottom wall on which said unit is adapted to stand,
- a horizontally disposed top wall spaced above the bottom wall,
- an opposed pair of upwardly extending side walls each joining a respective side edge of each of the bottom and top walls, and
- an upwardly extending rear wall which joins a rear edge of the bottom and top walls and a respective rear edge of each side wall, to close the interior of the body member at the rear thereof,
- said outer body portion defining an access opening to said interior, spaced forwardly from said rear wall, said access opening having a periphery defined by said bottom, top and pair of side walls;

(b) said inner body portion is integral with each of the bottom, top, side and rear walls of said outer body portion, and has a dimension forwardly of said rear wall which is less than the corresponding dimension of each of said bottom, top and side walls such that said inner body portion defines a front surface which extends across said access opening, said front surface being spaced inwardly form a forward edge of each of said bottom, top and side walls by a minor part of said corresponding dimension;

(c) said inner body potion defines an array of chambers, each extending from said front surface thereof to the rear wall of the outer body portion, and each of a cross section to enable the main body portion of a respective bottle of wine to be received end-wise therein via said access opening;

(d) the cover member is of panel form and adapted to provide a separable closure for said access opening, said cover member having an inner major surface, an outer major surface, and a side surface which joins said inner and outer surfaces around the periphery thereof, said side surface being stepped between said inner and outer major surfaces to define a peripheral flange adjacent the outer major surface and a peripheral sealing surface between the flange and the inner major surface such that, on presentation of the cover member to the access opening with the inner major surface thereof opposed to the front surface of the inner body portion of the body member, said flange abuts against the forward edge of the bottom, top and side walls of the outer body portion and the sealing surface achieves a friction fit within said access opening;

said access opening, between the front wall and the forward edge of said bottom, top and side walls, and the sealing surface of said cover member are of complementary form in which said access opening has a periphery which, in a first, minor part of the width thereof, is substantially perpendicular to said forward surface and a second, major part of which flares outwardly at an angle from 5° to 15° towards said forward edges, said sealing surface has a first, minor part of the width thereof which is substantially perpendicular to said inner major surface and a second, major part which flares outwardly at an angle from 5° to 15° from said inner major surface towards said outer major surface, such that, as said cover member is presented to the body member to close said access opening, there is movement of the inner major surface within the access opening to a position adjacent the forward surface, with said friction fit being achieved only in a final, minor stage of that movement by engagement of the respective said first, minor parts;

(f) the cover member defines an array of recesses, each extending from the inner major surface thereof towards the outer major surface and each positioned and of a cross-section such that, with a respective wine bottle received end-wise in each of said chambers and the cover member closing said access opening, the neck portion of each bottle is accommodated within a respective recess;

(g) the body member and the cover member each is formed of a foamed plastics insulation material comprising foamed polystyrene, and has a density of from 25 to 35 g/liter;

(h) the body member has a minimum thickness, from said chambers to the exterior of each of said bottom, top, side and rear walls of 4.5 cm; and (i) the cover member has a minimum thickness from said recess to said outer major surface of 4.5 cm.

2. The unit of claim 1, wherein said flange is provided with finger-grip recesses by which a user can grip the cover member for its removal from the body member.

3. The unit of claim 1, wherein each said first minor part is from 10 to 20 mm in width.

4. The unit of claim 1, wherein said chambers are round in cross-section when viewed from said opening.

5. The unit of claim 1, wherein at least one groove is provided in the peripheral edge of said cover member, said groove extending from said inner face towards said outer face to facilitate the egress and ingress of air respectively from and into said body member as said cover member is applied to and removed from said body member.

* * * * *